US005844480A

United States Patent [19]

Vanmoor

[11] Patent Number: 5,844,480

[45] Date of Patent: Dec. 1, 1998

[54] SHOPPING CART RETENTION ENTRANCE

[76] Inventor: Arthur Vanmoor, 18761 W. Dixie Hwy., North Miami Beach, Fla. 33180

[21] Appl. No.: 754,028

[22] Filed: Nov. 20, 1996

[30] Foreign Application Priority Data

Mar. 14, 1996 [NL] Netherlands ..... 1002611

[51] Int. Cl.[6] ..... G08B 21/00; B60T 3/00

[52] U.S. Cl. ..... 340/540; 188/32; 109/1 R; 109/2

[58] Field of Search ..... 340/541, 691, 340/933, 540, 571, 693; 188/32; 404/1, 6; 109/1 R, 2; 280/33.994

[56] References Cited

U.S. PATENT DOCUMENTS 3,459,280 8/1969 Grimm ..... 404/6
3,993,006 11/1976 Connolly ..... 109/1 R
4,101,234 7/1978 Castaneda ..... 404/6
4,120,384 10/1978 Choy ..... 280/33.994
5,383,639 1/1995 Byard ..... 248/346.1

*Primary Examiner*—Brent A. Swarthout
*Assistant Examiner*—Van T. Trieu
*Attorney, Agent, or Firm*—Herbert L. Lerner; Laurence A. Greenberg

[57] ABSTRACT

In combination with a barrier for retaining shopping carts around a parking lot, a vehicle entrance includes a roadway having a surface and a plurality of geometric objects protruding upward from the surface for entrapping a wheel of a shopping cart when the wheel of the shopping cart is pushed over the geometric objects. Another embodiment includes a water trap in the roadway. All of the embodiments of the invention help retain shopping carts within a confined area such as a parking lot.

3 Claims, 5 Drawing Sheets

SHOPPING CART RETENTION ENTRANCE

BACKGROUND OF THE INVENTION

1. Field of the Invention

The invention relates to objects and devices used to help retain shopping carts within the confined area of a parking lot.

2. Description of the Related Art

One common device used to retain shopping carts within the boundaries of a parking lot is a barrier. Barriers such as walls made from concrete blocks or metal posts are placed around the perimeter of the parking lot. The barrier is constructed in such a manner as to prevent the removal of the shopping cart. Although the barrier device is effective at preventing the removal of shopping carts at pedestrian entrances, it does not address the problem of the removal of a shopping cart via the motor vehicle entrance.

That short fall led to the development of devices to be attached to the shopping cart. Such developments included electronic tracking devices, beepers and automatic wheel locking units. Those devices would activate when the shopping cart was removed from the specified boundaries of the parking lot. One example is the shopping cart equipped with a retractable fifth wheel. When the shopping cart senses that it is being lifted, such as being lifted over a perimeter retention wall, a fifth wheel is automatically lowered from its retracted position. The lowered fifth wheel lifts and locks the shopping cart in such a manner that further movement of the shopping cart is inhibited.

However, the advantages of the prior art devices did not outweigh their disadvantages. The disadvantages of the attachment devices included: a. the expense of supplying one device per cart, b. the cost of maintaining, repairing and replacing the devices, and c. the ease of device circumvention.

SUMMARY OF THE INVENTION

It is accordingly an object of the invention to provide, a shopping cart retention entrance which overcomes the herein-mentioned disadvantages of the heretofore-known devices of this general type, and provides a cost effective vehicle entrance which makes it difficult to remove a shopping cart from a designated parking lot.

With the foregoing and other objects in view there is provided, in accordance with the invention, a combination of a barrier for retaining shopping carts around a parking lot, and a vehicle entrance comprising a roadway having a surface; and a plurality of geometric objects protruding upward from the surface for entrapping a wheel of a shopping cart when the wheel of the shopping cart is pushed over the geometric objects.

In accordance with another feature of the invention, the goemetric objects have a given height greater than the radius of the wheel of the shopping cart, and a given distance between the geometric objects is greater than the diameter of the wheel of the shopping cart.

In accordance with an added feature of the invention, the geometric objects are block like in shape.

In accordance with another feature of the invention, the geometric objects are tube like in shape.

In accordance with an additional feature of the invention, the geometric objects are shaped in sinusoidal wave like forms.

In accordance with a concomitant feature of the invention, the geometric objects are v-shaped like blocks.

A second embodiment of the invention provides a combination of a barrier for retaining shopping carts around a parking lot, and a vehicle entrance comprising a roadway; a housing being formed over the roadway; a plurality of sprinklers disposed in the housing; and at least one motion sensor located in the housing for controlling the sprinklers, the at least one motion sensor activating the sprinklers when the at least one motion sensor detects motion in the housing for deterring the removal of a shopping cart from the vehicle entrance.

A third embodiment of the invention provides a combination of a barrier for retaining shopping carts around a parking lot, and a vehicle entrance comprising a roadway; a water trap in the roadway, the water trap having sides and a pool of water for inhibiting movement of a shopping cart through the vehicle entrance; and a ramp on each side of the water trap over which a vehicle is lowered into the water trap.

A fourth embodiment of the invention provides a combination of a barrier for retaining shopping carts around a parking lot having an exit road, and a vehicle entrance comprising a housing; a ramp unit being articulatingly connected to the housing, the ramp unit having a roadway to be traversed by a motor vehicle; and a movable, controlled counter weight being connected to the roadway for moving the roadway about its axis and causing the roadway to lower to the exit road.

Other characteristic features of the invention are set forth in the appended claims.

Although the invention is illustrated and described herein as embodied in a shopping cart retention entrance, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
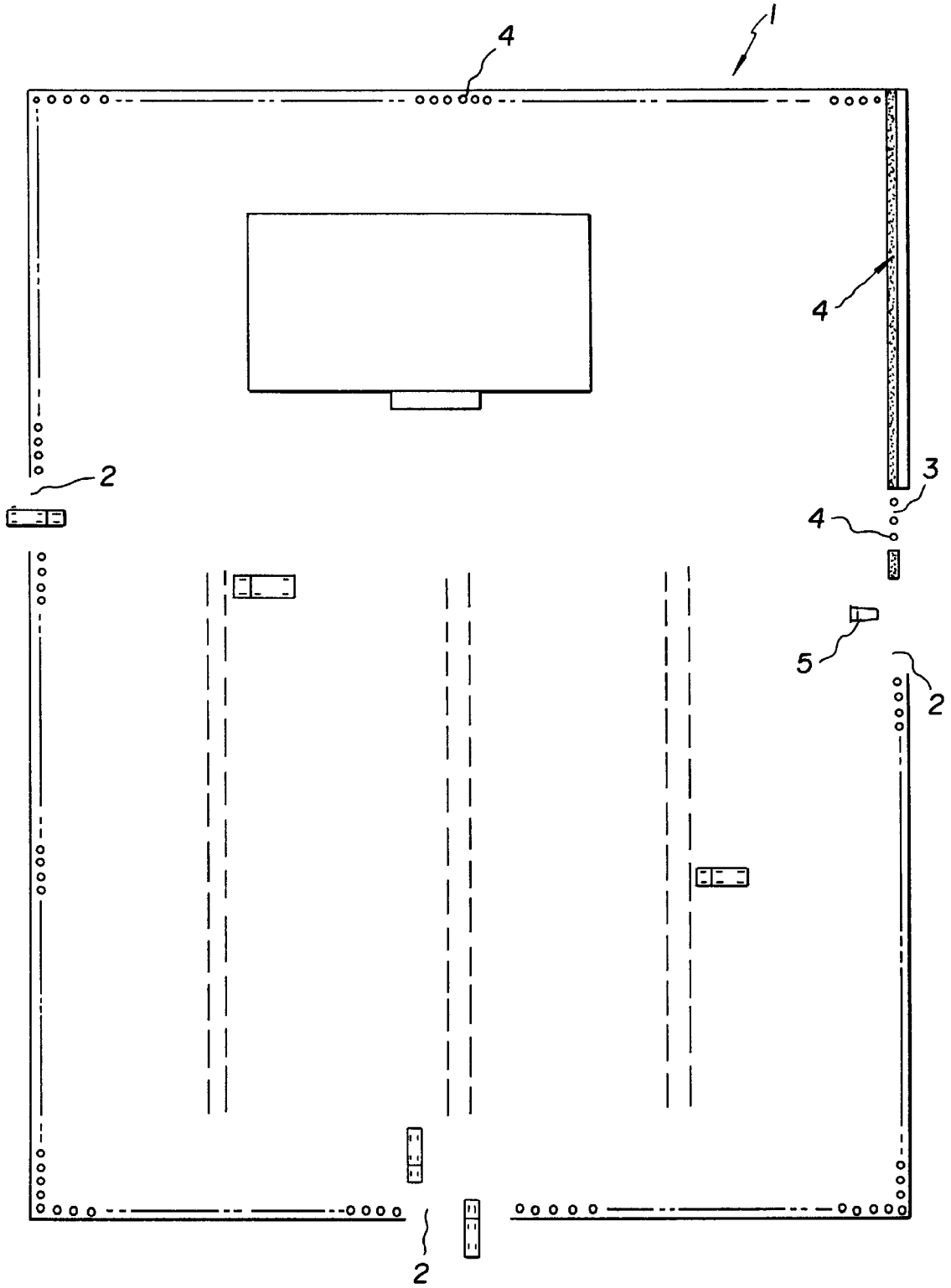
FIG. 1 is a diagramatic, top-plan view of a typical parking lot arrangement according to the invention.

Referring now to the figures of the drawings in detail and first, particularly, to FIG. 1 thereof, there is shown a typical parking lot 1 surrounded by a barrier 4. The barrier can be a cement wall, a ring of metal posts or other suitable materials for forming the barrier 4. The parking lot 1 has multiple vehicle entrances 2 and a pedestrian entrance 3. The vehicle entrances 2 are not obstructed and a shopping cart 5 could be easily removed from the parking lot 1. The pedestrian entrance 3 is obstructed by the post barrier 4 such that the removal of the shopping cart is difficult.

Figure 2:
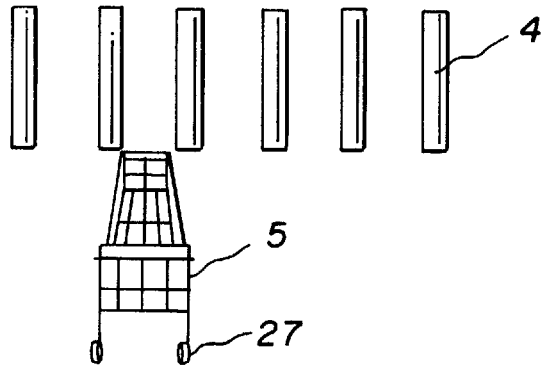
FIG. 2 is a perspective view of a shopping cart and retention posts.

FIG. 2 shows how the post barrier 4 is formed such that the removal of the shopping cart 5 at the pedestrian entrance 3 is inhibited. The shopping cart has wheels 27 which will be discussed below.

Figure 3:
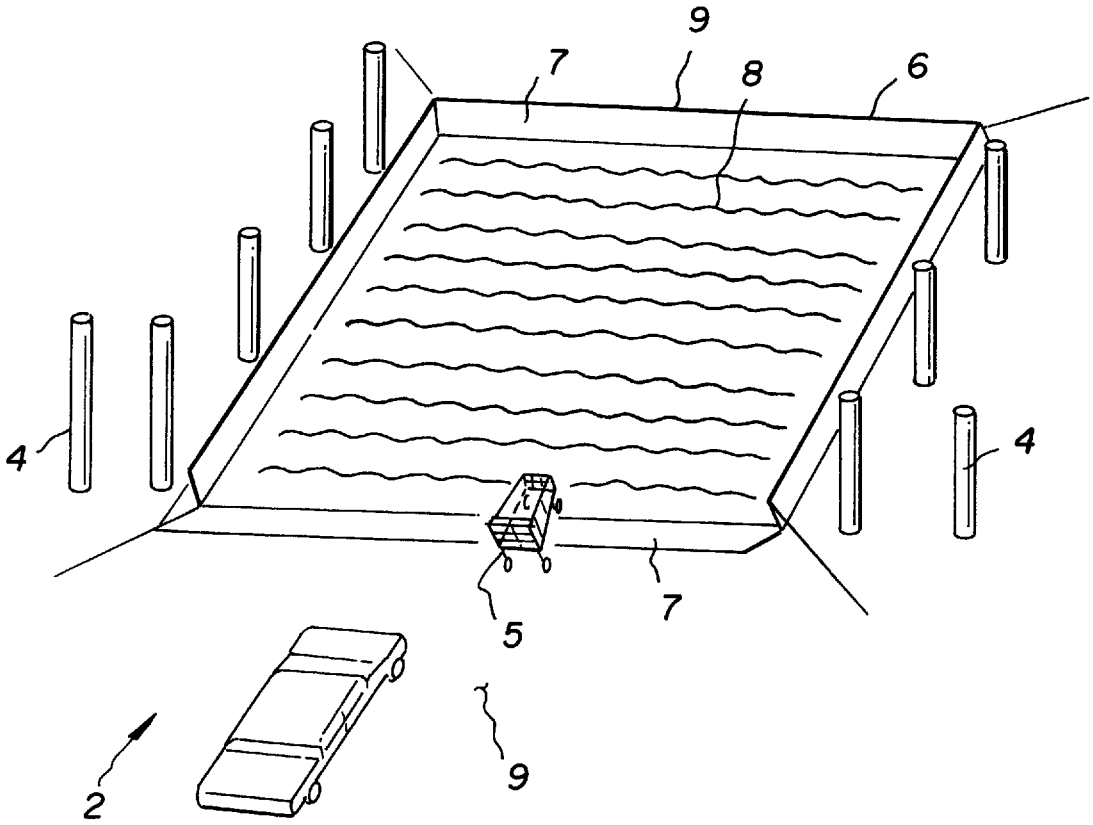
FIG. 3 is a perspective view of a vehicle entrance formed with a water trap.

FIG. 3 shows one of multiple embodiments of the invention of the instant applicant constructed to allow the passage of a motor vehicle through the vehicle entrance 2, with minimal obstruction to movement of the vehicle, but at the same time obstructing the movement of the shopping cart 5 at the vehicle entrance 2. FIG. 3 shows the vehicle entrance having a water trap 6. The water trap 6 has ramps 7 on both sides to lower the roadway 9. The water trap 6 contains a pool of water 8. A person removing the shopping cart 5 from the parking lot 1 would have to traverse the pool of water 8 to remove the cart 5. The pool of water 8 provides a deterrent to the removal of the shopping cart 5 but at the same time minimally interferes with the motor vehicle traversing the vehicle entrance 2.

Figure 4A:
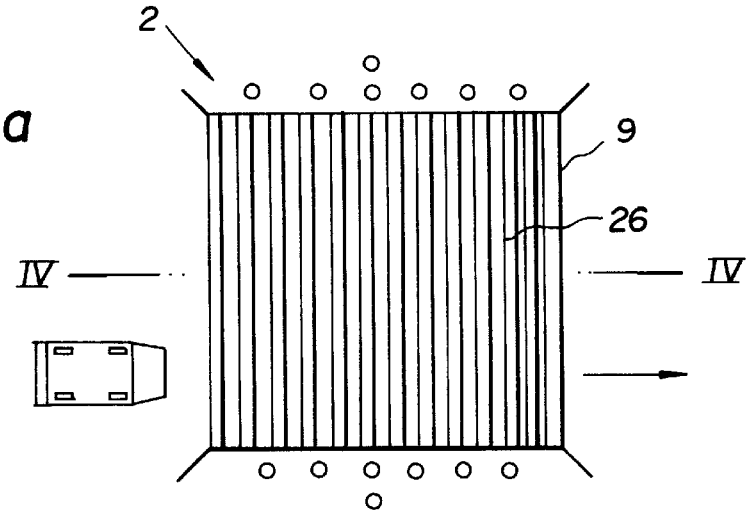
FIG. 4*a* is a top-plan view of the vehicle entrance formed with a roadway having protruding geometric shapes.
Figure 4B:
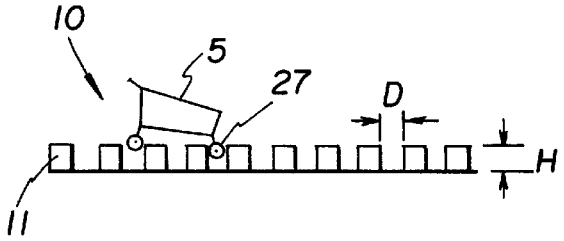
FIG. 4*b* is a sectional view taken along the line IV—IV shown in FIG. 4*a* and shows a block surface of the roadway entrance.
Figure 4C:
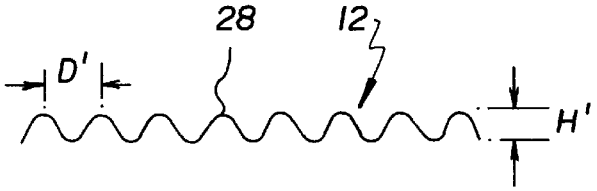
FIG. 4*c* is a sectional view taken along the line IV—IV shown in FIG. 4*a* and shows a sinusoidal surface of the roadway entrance.
Figure 4D:
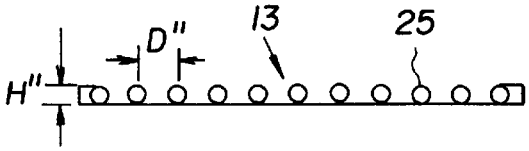
FIG. 4*d* is a sectional view taken along the line IV—IV shown in FIG. 4*a* and shows a tube surface of the roadway entrance.
Figure 4E:
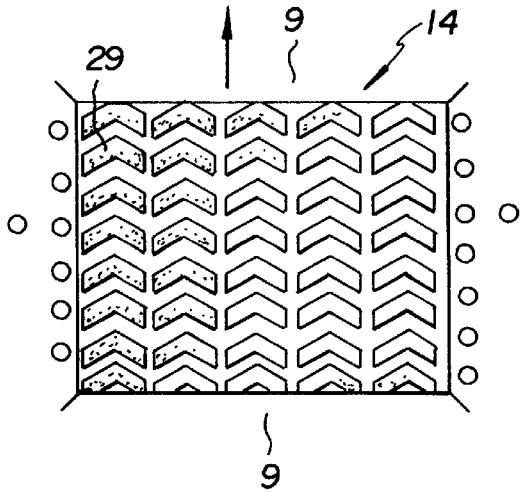
FIG. 4*e* is a top-plan view of the vehicle entrance formed with the roadway having protruding v-shaped objects.
Figure 4F:
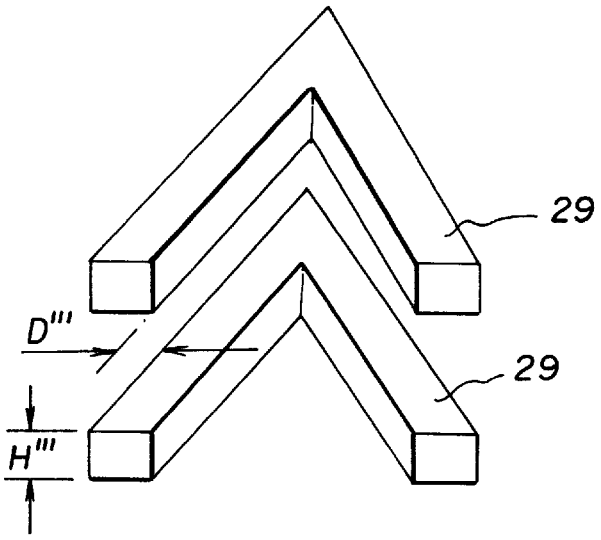
FIG. 4*f* is an enlarged perspective view of the v-shaped objects.

FIG. 4*a* shows a vehicle entrance 2 formed of a roadway 9 having a surface 26. The surface 26 of the roadway 9 is constructed in such a way that the wheels of the motor vehicle can easily pass over the roadway 9 but that the wheel 27 of the shopping cart 5, shown in FIGS. 2 and 4*b*, would get stuck in the surface 26 of the roadway 9 making the removal of the shopping cart 5 a tedious task. The surface 26 can be formed of various geometric shapes or objects as shown in FIGS. 4*b*–4*f*. FIG. 4*b* shows the surface 26 of the roadway 9 constructed with a block surface 10. The block surface 10 is formed of blocks 11 spaced apart a distance D and having a height H to allow vehicle traffic but to interfere with the movement of the wheels 27 of the shopping cart 5. In an alternative, FIG. 4*c* shows the roadway 9 formed with a sinusoidal surface 12. The sinusoidal surface 12 is configured with wave forms 28 spaced apart a distance D' and having a height H' to allow vehicle traffic but to interfere with the movement of the wheels 27 of the shopping cart 5. In another alternative, FIG. 4*d* shows the surface 26 of the roadway 9 formed with a tube or pipe surface 13. The tube surface 13 is constructed with metal tubes 25 spaced apart a distance D" and having a height H" to allow vehicle traffic but to interfere with the movement of the wheels 27 of the shopping cart 5. FIGS. 4*e* and 4*f* show another alternative to the surface 26 of the roadway 9.

The surface 26 of the roadway 9 can be formed in a v-shaped configuration 14. The v-shaped configuration 14 is constructed with v-shaped blocks 29 laid across the roadway 9. The v-shaped blocks are spaced apart a distance D'" and having a height H'" to allow vehicle traffic but to interfere with the movement of the wheels 27 of the shopping cart 5. It is clear that many shapes can be substituted for the v-shaped configuration 14 as long as they inhibit the movement of the wheels of the shopping cart but minimally inhibit the movement of the vehicle. The heights H, H', H" and H'" are greater than a radius of the shopping cart wheel 27. The distances D, D', D" and D'" between the geometric objects are greater than a diameter of the shopping cart wheel 27.

Figure 5A:
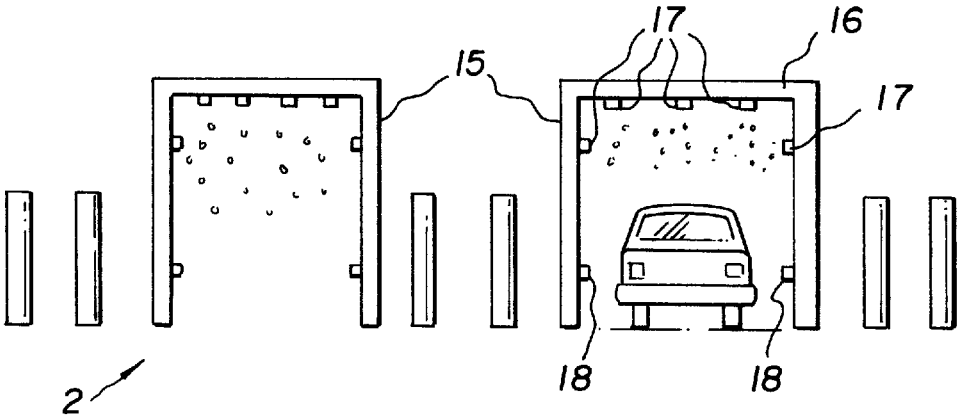
FIG. 5*a* is a front-elevation view of the vehicle entrance having a water tunnel.
Figure 5B:
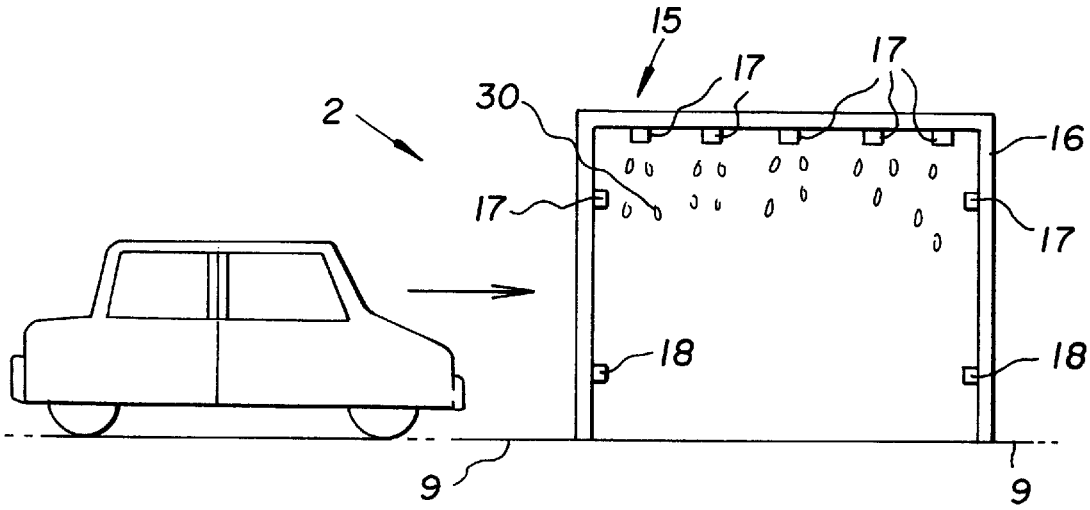
FIG. 5*b* is a side-elevation view of the water tunnel.

FIGS. 5*a* and 5*b* show the vehicle entrance 2 being enclosed by a water tunnel 15. The water tunnel 15 is composed of a housing 16 containing multiple shower heads or sprinklers 17 and multiple motion sensors/controllers 18. As a moving body such as the vehicle enters the housing 16 of the water tunnel 15, the motion sensors/controllers 18 detect the movement and activate the shower heads 17 causing a stream of water 30 to be ejected within the confines of the housing 16. The stream of water 30 does not interfere with the movement of the vehicle but does provide a deterrent to an individual thinking of removing a shopping cart from the parking lot 1. In an alternative embodiment, the housing 16 could contain an automatic car wash.

Figure 6A:
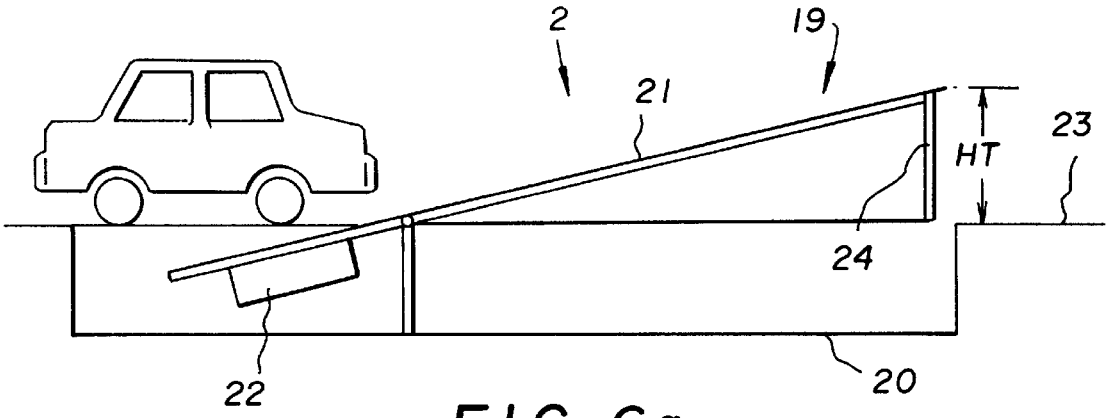
FIG. 6*a* is a side-elevation view of the vehicle entrance having a ramp unit in a raised position.
Figure 6B:
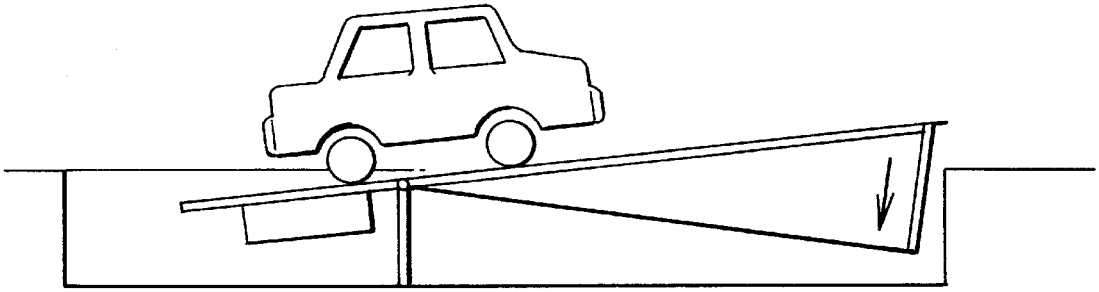
FIG. 6*b* is a side-elevation view of the vehicle entrance having the ramp unit in a partially lowered position.
Figure 6C:
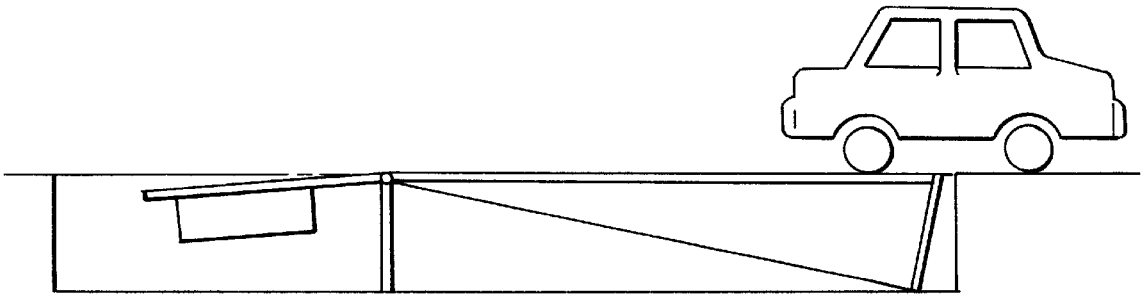
FIG. 6*c* is a side-elevation view of the vehicle entrance having the ramp unit in a fully lowered position.

FIG. 6*a* shows the vehicle entrance 2 having a ramp unit 19. The ramp unit 19 extends a height HT above an exit road 23 such that the removal of the shopping cart requires overcoming the height HT at a raised ramp end 24. The ramp unit 19 has a housing 20. Articulatingly connected to the housing 20 is a roadway 21. When an automobile drives onto the roadway 21, the weight of the automobile lowers the roadway 21, as shown in FIGS. 6*b* and 6*c*, such that roadway 19 is flush with the exit road 23. The ramp unit 19 is calibrated as requiring a weight greater than that of a person and the loaded shopping cart in order to lower the ramp unit 19. The ramp unit 19 has a movable, sensor controlled, counter weight unit 22 which opposes the weight of the vehicle. When the weight of the automobile is no longer sensed by the counter weight unit 22, the counter weight unit 22 moves and acts upon the roadway 21 such that it automatically raises the roadway 21 to its raised position as shown by the height HT.

I claim:

1. In combination with a barrier for retaining shopping carts around a parking lot, a vehicle entrance comprising:

a roadway having a surface;

a plurality of geometric objects protruding upward from said surface for entrapping a wheel of a shopping cart when the wheel of the shopping cart is pushed over said geometric objects, said geometric objects being v-shaped blocks; and said v-shaped blocks having a given height greater than a radius of the shopping cart wheel, and a given distance between said v-shaped blocks greater than a diameter of the wheel of the shopping cart, said v-shaped blocks being aligned for providing minimal interference with a travel motion of wheels of an automobile.

2. The vehicle entrance according to claim 1, wherein said geometric objects are successively aligned behind each other and next to each other.

3. In combination with a barrier for retaining shopping carts around a parking lot, a vehicle entrance comprising:

a roadway;

a water trap in said roadway, said water trap having sides and a pool of water for inhibiting movement of a shopping cart through the vehicle entrance; and a ramp on each side of said water trap over which a vehicle is lowered into said water trap.

* * * * *